US005988712A

United States Patent [19]

Segelin

[11] Patent Number: 5,988,712

[45] Date of Patent: Nov. 23, 1999

[54] INSERTABLE MOTOR VEHICLE ANTI-THEFT DEVICE

[75] Inventor: William Robert Segelin, Utica, N.Y.

[73] Assignee: Worldwide Jimmy Block, LLC., Derby, N.Y.

[21] Appl. No.: 09/035,826

[22] Filed: Mar. 6, 1998

[51] Int. Cl.[6] ..... E05B 17/00

[52] U.S. Cl. ..... 292/346; 292/1; 292/288; 292/343; 70/DIG. 43; 70/1.5; 70/418; 81/15.9

[58] Field of Search ..... 292/346, 1, 288, 292/289, 2, 358, 343, 337; 70/DIG. 43, DIG. 56, 1.5, 14, 57, 465, 418; 81/15.9

[56] References Cited

U.S. PATENT DOCUMENTS

| | | | |
|---|---|---|---|
| 1,970,879 | 8/1934 | Bell | 292/343 |
| 3,124,382 | 3/1964 | Strother | 292/343 |
| 3,612,588 | 10/1971 | Roppo | 292/1 |
| 4,101,155 | 7/1978 | Cohen | 292/347 |
| 4,113,294 | 9/1978 | Bierman | 292/346 |
| 4,205,868 | 6/1980 | Kurth | 292/347 |
| 4,628,300 | 12/1986 | Amato | 340/542 |
| 4,630,854 | 12/1986 | Persson et al. | 292/343 |
| 4,932,708 | 6/1990 | Taub | 292/347 |
| 4,958,869 | 9/1990 | Bisher | 292/339 |
| 5,217,269 | 6/1993 | Wiltberger | 292/343 |
| 5,676,002 | 10/1997 | Hoeptner, III | 70/416 |

*Primary Examiner*—Darnell M. Boucher
*Assistant Examiner*—Clifford B Vaterlaus
*Attorney, Agent, or Firm*—Sughrue, Mion, Zinn, Macpeak & Seas, PLLC

[57] ABSTRACT

An anti-theft device is constituted by an elongated rod of a width less than the gap between a window glass pane and a facing inner edge of a window sill for an automobile door interior panel. A shield plate is fixed to and extends radially outward to one side of the rod at a distal end, and a wedge is fixed to and extends alongside the rod adjacent the proximate end, with the wedge having a thickness greater than the width of the gap and tapering over its length to a tapered leading edge facing the trailing edge of the shield plate. By inserting the shield plate into the interior of the door within the gap and twisting the rod about the axis, the wedge is forced into frictional locking position between the inside of the window glass pane and the window sill, with the shield plate covering the door mechanism actuating lever.

9 Claims, 4 Drawing Sheets

INSERTABLE MOTOR VEHICLE ANTI-THEFT DEVICE

FIELD OF THE INVENTION

This invention relates to a theft deterring device to be manually, temporarily installed in a motor vehicle such as a car, van or truck to prevent a non-authorized person from inserting a stiff rod or rigid flat strip of material into the space between a vehicle door window pane in the outside panel of the door to mechanically release the lock actuating levers within the vehicle door, and more particularly to a device which is manually wedged into position between the window pane and the window sill of the inside panel of the door to frictionally lock the anti-theft device in place and which is of simple construction unitary in nature and of preferably molded plastic or welded metal components.

BACKGROUND OF THE INVENTION

Motor vehicle anti-theft devices are known in the art. U.S. Pat. No. 4,113,294 is directed to an anti-theft clip for securing a lock cylinder to a car door consisting of panels attached to resilient legs which straddle and hold the lock cylinder, however, the device does not protect against the downward insertion of a stiff rod to reach the lock levers.

U.S. Pat. No. 4,628,300 is directed specifically to a motor vehicle anti-theft device designed to prevent access to the levers which control the operating of the door lock within a vehicle door. An L-shaped metal plate including a horizontal cover strip of rigid material of predetermined length and width is employed to substantially cover the space between the vehicle window glass pane and the outside panel of a vehicle door with a vertically downwardly projecting right angle support strip which is attached internally within the door cavity to the sash of the automobile window to prevent the insertion of a tool to release the lock actuating levers within the vehicle door.

The anti-theft device of the U.S. Pat. No. 4,628,300 requires access to the interior cavity between the exterior door panel and the interior door panel and a permanent modification of the vehicle door assembly.

It is therefore an object of the present invention to provide an improved, simple, unitary anti-theft device for blocking access to the insertion of a thin metal tool between the window pane and the exterior panel of a vehicle door to move one or more of the actuating lever arms attached to the door latch release mechanism which may be manually inserted between the interior door panel and the window glass pane, which device may be frictionally locked in place and which carries a shield plate of predetermined size which is effectively positioned adjacent to the door latch release mechanism thereby preventing contact by an inserted metal tool attempting to mechanically release the door latch mechanism.

SUMMARY OF THE INVENTION

The present invention resides in a motor vehicle anti-theft device for a motor vehicle door having an outside door panel and an inside door panel defining a cavity between the door panel, a door lock with at least one lever controlling the lock within the cavity, an opening within the door, a window sash about the opening, and a window glass pane held by the door within the window sash. The device includes an elongated rod of predetermined length of a diameter or width less than the gap between the window glass pane and a facing inner edge of a window sill at least partially defined by the interior panel of the door. The rod has an axis, an upper proximate end and a lower distal end. A shield plate is fixed to and extends radially outwardly to one side of the rod, at the distal end. A wedge is fixed to and extends alongside the rod adjacent the proximate end of the rod, the wedge having a thickness greater than the width of the gap between the window glass pane and the edge of the window sill and having a tapered leading edge facing a trailing edge of the shield plate and being spaced therefrom and having a base of a width in excess of the space between the window glass pane and the facing edge of the window sill. The distance between the shield plate and the wedge is such that by inserting the distal end of the elongated rod between the interior surface of the window glass pane and the facing edge of the window sill from the inside of the vehicle to the extent of the wedge frictionally locking itself between the inside of the window glass pane and the window sill, the shield plate is properly positioned adjacent to and overlying the door latch mechanism actuating lever, thereby preventing a thin metal tool from engaging and manipulating the door latch release mechanism upon insertion of the tool between the outer door panel and the window glass pane.

The wedge may be centered laterally on the rod, or may project to one side of the rod. The anti-theft device may be of molded, generally rigid plastic, or may be made of other material such as metal, with one or both of the wedge and shield plate welded to the rod. Preferably, the proximate end of the rod to the side of the wedge remote from the shield plate may terminate in a hook to facilitate manual extraction of the device to release the friction grip between the wedge and the facing surfaces of the window glass pane and the window sill. The leading edge of the wedge may be angularly offset from the leading edge of the shield plate, along the longitudinal axis of the elongated rod. If angularly offset, the angle may be approximately 90° between the leading edges of the wedge and the shield plate. The wedge is tapered over its length parallel to the longitudinal axis of the rod, and the shield plate whose thickness is less than the gap between the window glass pane and the facing edge of the window sill has a tapered leading edge to facilitate insertion of the shield plate between the interior door panel window sill and the window glass pane. The leading edge of the shield plate may be oblique to the rod axis at a predetermined angle from the distal end of the rod to the proximate end to deter dislodgement of the anti-theft device after insertion in the door panel by the thin metal tool.

DESCRIPTION OF THE PREFERRED EMBODIMENT

Figure 1:
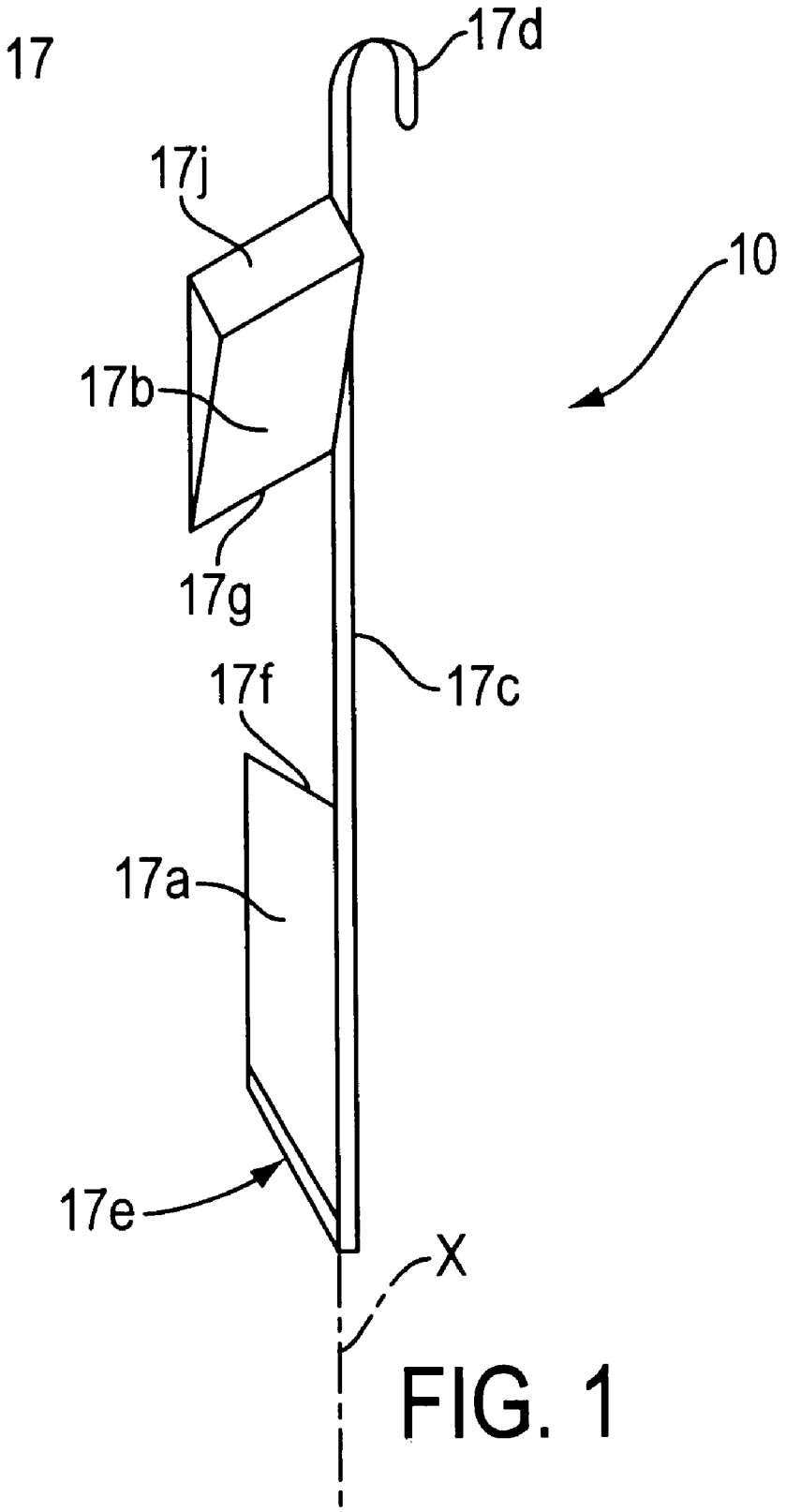
FIG. 1 is an isometric drawing of a motor vehicle anti-theft device forming a preferred embodiment of the invention.
Figure 3:
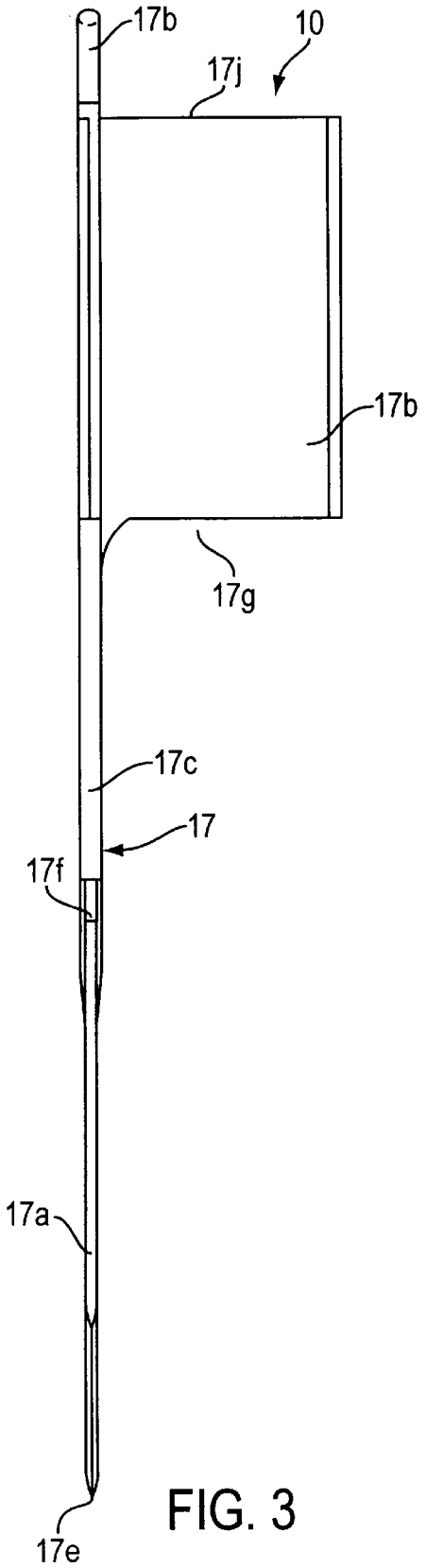
FIG. 3 is a front elevational view of the device of FIG. 1.
Figure 2:
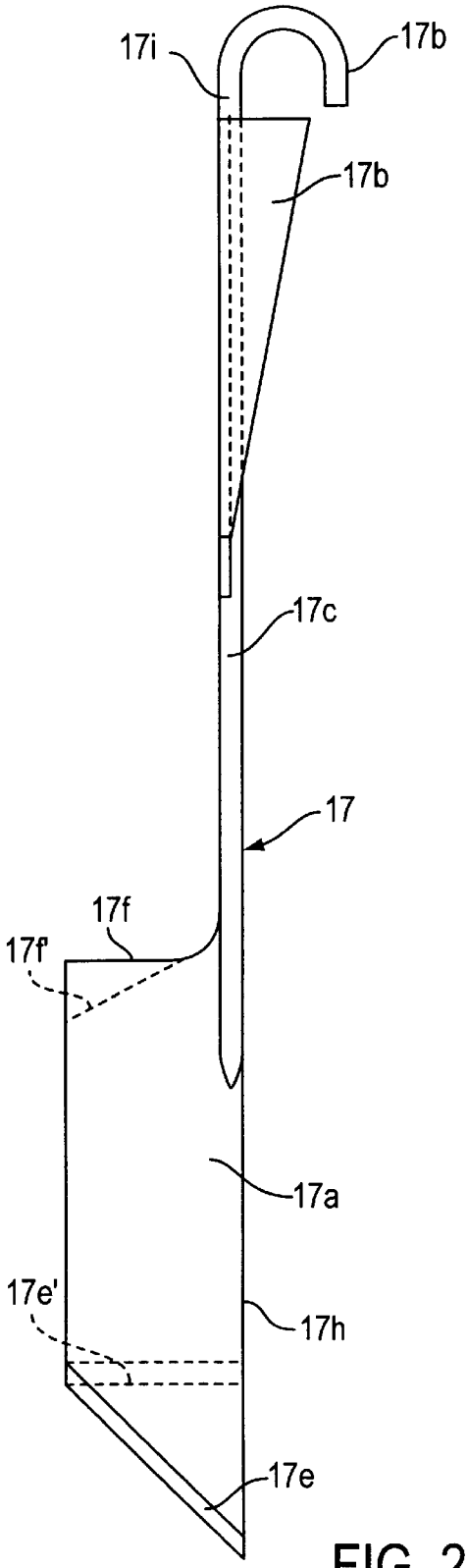
FIG. 2 is a side elevational view of the device of FIG. 1.

Referring particularly to drawing FIGS. 1–3 within the several views, the anti-theft device indicated generally at 10 and forming a preferred embodiment of the invention has like parts designated by like numerals. The illustrated embodiment is preferably formed of molded plastic, but may be formed of metal or other suitable material. The anti-theft device 10 is of a single casting 17 including an elongated rod 17*c* of circular cross-section. Alternatively, the rod could be square in cross-section. The device 10 has integrally molded components in addition to rod 17*c,* a radially projecting thin shield plate 17*a* at a distal lower end 17*h* of the rod, and a reverse turn hook 17*b* at an opposite proximal end 17*i.*

Near the proximal end 17*i* of the anti-theft device 10 there is an integrally molded tapered plate or wedge 17*b* which also projects radially outwardly of rod 17*c* from one side at an angular offsetting from the plane of shield plate 17*a.* In the preferred embodiment, that angular offset is approximately 90°. A lower leading edge 17*e* of shield plate 17*a* is of tapered V-shape, and the shield plate 17*a* has an opposite trailing edge 17*f.* While the shield plate 17*a* is of trapezoidal plan configuration, including a trailing edge as at 17*e'* illustrated in dotted lines, FIG. 2, and may have a like oppositely inclined trailing edge 17*f',* it may be trapezoidal or oval in form. In turn, the wedge 17*b* is provided with a straight leading edge 17*g* and a trailing edge or base 17*j.* When viewed from the side, the wedge 17*b* is seen as having a right triangular cross-section with a continuing taper from base 17*j* to leading edge 17*g.* As such, in the vicinity of the leading edge, the width or thickness of the wedge is less than the gap between the vehicle door window glass pane 11, FIGS. 4 and 5, and the facing edge of the door window sill 12*d,* FIG. 4. Preferably, the wedge 17*b* and the shield plate 17*a* are circumferentially spaced about the periphery of the rod 17*c* by an angle of approximately 90° and are spaced longitudinally some distance apart, that distance being predetermined such that with the wedge 17*b* in its forced, fully inserted, frictionally locked position snugly between the window glass pane 11 and the door window sill 12*d* interior panel edge, the shield plate 17*a* is proximate to or in contact with and overlying the latch release mechanism 14 as shown in drawing FIGS. 4 and 5. Once the shield plate 17*a* is fully inserted within that gap, the rod 17*c* is rotated to align the wedge of leading edge 17*g* with that same gap, and then further inserted as far as possible and to effect the snug fit.

Figure 4:
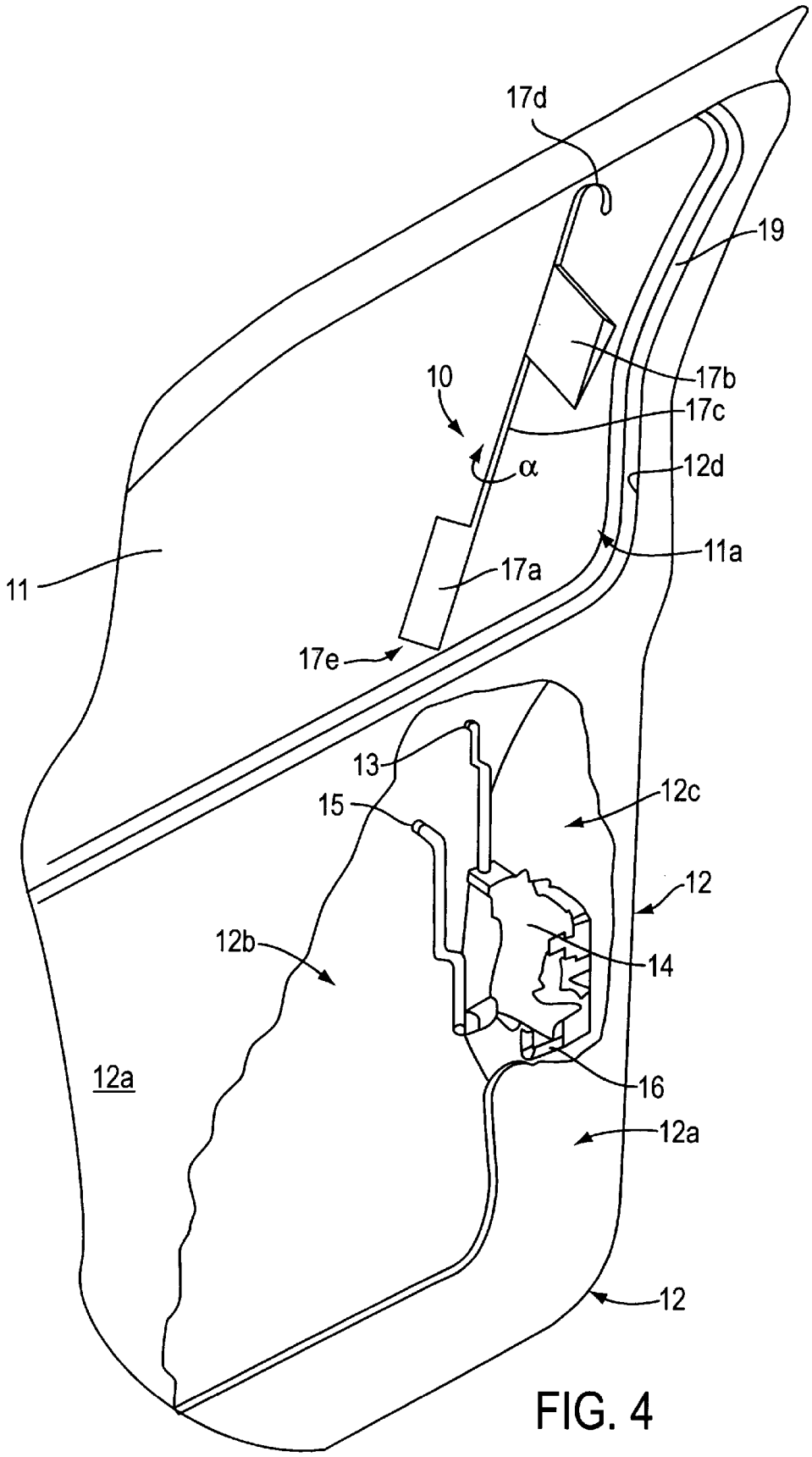
FIG. 4 is a partially fragmented, isometric view of a conventional car door illustrating the door latch release mechanism and several actuating arms for the same, with the anti-theft device in place for insertion of the shield plate in the gap between the interior door panel window sill and the window glass pane.
Figure 5:
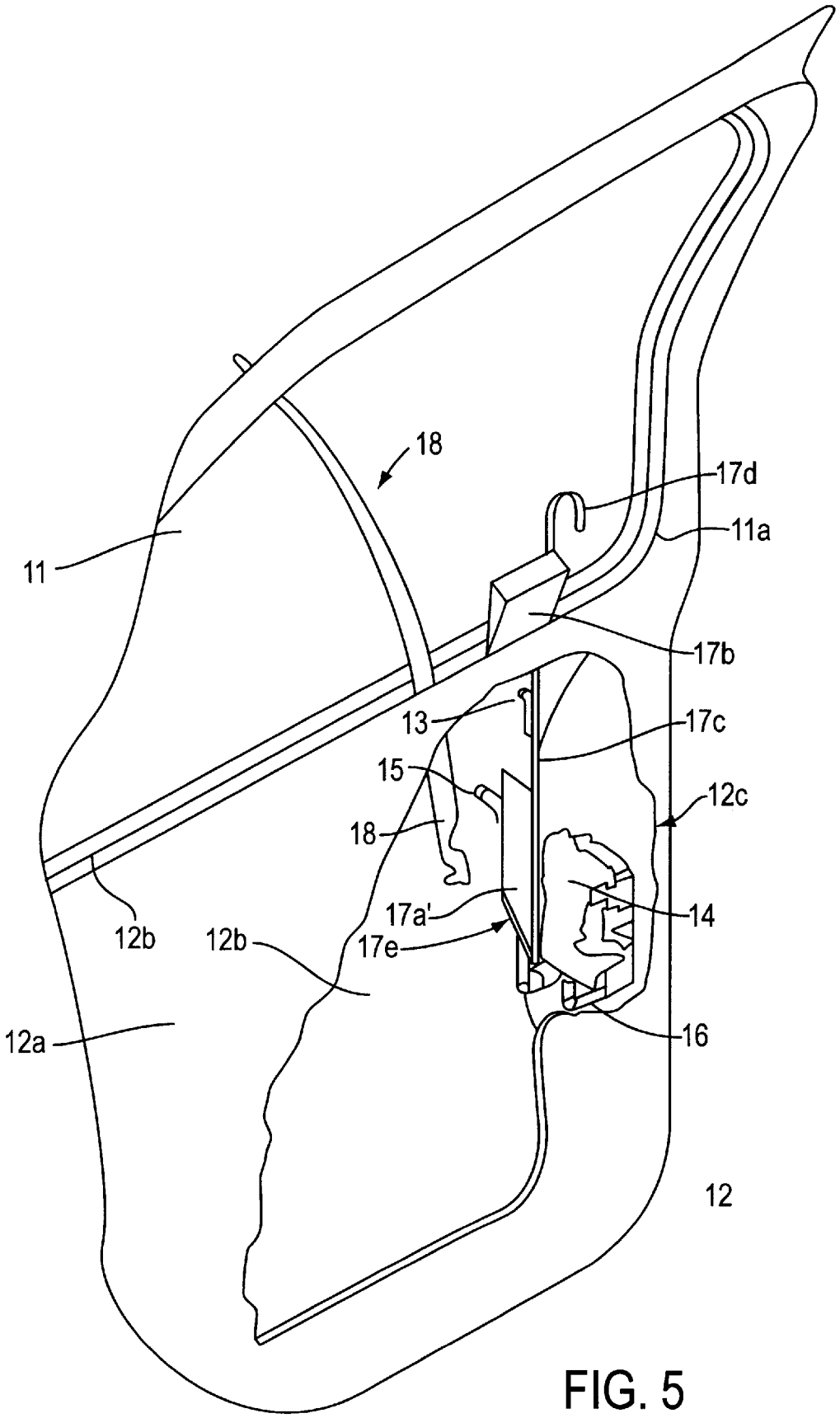
FIG. 5 is an isometric view, partially broken away and similar to that of FIG. 4, with the motor vehicle anti-theft device fully inserted to the extent of the wedge frictionally locked between the window glass pane and the interior panel window sill after rotation of the elongated rod about its axis to align the leading edge of the wedge with the gap between the window glass pane and the window sill, while illustrating the inability of an inserted jimmy tool to contact the latch release mechanism due to the presence of the shield plate in proximity and overlying the door latch release mechanism.

The insertion of the anti-theft device 10 shield plate 17*a* into the door interior cavity in the manner of the locking of the same in position relative to the latch release mechanism by way of wedge 17*b* can be best appreciated by viewing FIGS. 4 and 5. The partially broken away isometric view of FIG. 4 shows a conventional car door 12 and illustrates those portions of the door and the door interior cavity 12*c* germane to the present invention. The door indicated generally at 12 consists of an interior panel 12*a* and an exterior panel 12*b* with an opening within the door for receiving the window glass pane 11. Located within the door interior cavity 12*c* are a typical latch release mechanism 14 and related door cylinder lock 15, door handle 13, an interior lock 16 actuation rod and lever assembly. Also as seen in FIG. 4, a rubber molding 19 aligns the window opening. As per FIG. 4, to permit insertion of the lower shield plate 17*a* within car interior cavity 12*c,* the shield plate is positioned parallel to the plane of the window glass pane 11 and its leading edge 17*e* is inserted in the gap between the window glass pane 11 and the interior door panel 12*a.* When the shield plate 17*a* is inserted to the extent that the wedge 17*b* comes into contact with window sill 12*d,* the anti-theft device 10 must be rotated about the axis of rod 17*c* such that the wedge 17*b* is parallel to the window glass pane 11, and with the lower shield plate 17*a* pointed towards the exterior door panel 12*b.* At this point, the shield plate 17*a* is in the vicinity of, but slightly above, the latch release mechanism 14. Pressing on the base 17*j* drives the wedge 17*b* downwardly within the gap until stopped by frictional engagement of opposite side faces, with the window glass pane 11 and the peripheral edge of the interior door panel 12*a* at sill 12*d.* The flat angled shield plate 17*a* is in a position so as to block the key lock mechanical arm from being manipulated by an unauthorized tool such as that commonly known under the trademark "SLIM JIM™", a common tool 18, FIG. 5, used by a car thief to unlock a car door. The wedge 17*a* fits snugly between the window glass pane and the interior door rubber molded gasket providing the required key lock blocking string to the flat angled shield plate 17*a,* FIG. 5. Thus, the 90° angled shield plate 17*a* in combination with the upper wedge 17*b* leaves the car thief with no leverage and no exposed area on the key lock mechanical arm, thereby eliminating the SLIM JIM™ as an effective entry tool. In FIG. 5, with the anti-theft device 10 in place and with the shield plate 17*a* properly positioned adjacent to or in contact with mechanism 14, the shield plate impedes tampering of the thin strip metal tool 18 with the latch release mechanism 14, the related door cylinder lock 15, the door handle 13 and the interior lock 16 actuating rod and the lever assemblies. While the thin metal tool 18, FIG. 5, could be inserted between the anti-theft device 10 and the edge of the window glass pane 11 at rear edge 11*a* to make contact with the latch release mechanism 14, related door cylinder lock 16, door handle 13 and interior lock 16 actuating rod and lever assemblies cannot be properly positioned to permit tampering with the latch release mechanism 14, related door cylinder lock 15, door handle 13 and interior lock 16 actuation rod and lever assemblies.

As may be appreciated, anti-theft devices such as that at 10 can be mounted temporarily to a plurality of doors within a car, truck or the like, while the vehicle is unoccupied and locked. The operator upon returning to the vehicle can readily detach the anti-theft devices at each door by reversing the procedure of insertion and forced snug contact of the wedge with opposing faces of the interior door and inside of the window glass pane.

Various changes may be made without departing from the spirit and scope of the invention. The preferred embodiment of the invention is illustrative only and modifications and variations in dimensions and content of the embodiments described above would occur to those skilled in the art without deviating from the invention. Within the scope of the appended claims, the invention may be practiced other than that as specifically described or shown above.

What is claimed is:

1. A motor vehicle anti-theft device for attachment to a motor vehicle door having an outside door panel and an inside door panel defining a cavity between the door and panel, a door lock with at least one actuating lever controlling the lock within the cavity, an opening within the door, a window sill about the opening, and a window glass pane held by the door within the window sill and forming a gap between said window glass panel and said sill, said device comprising:

an elongated rod of predetermined length and of a diameter or width adapted to be less than the gap between the window glass pane and the window sill, said rod further having an axis, an upper proximate end and a lower distal end;

a shield means for preventing access to said at least one actuating lever controlling the lock, said shield means being fixed to the rod distal end;

a wedge fixed to and extending alongside the rod adjacent the proximate end of the rod, the wedge having a base with a thickness adapted to be greater than the width of the gap between the window glass pane and the window sill, said wedge having a tapered leading edge facing a trailing edge of the shield means and being spaced therefrom, wherein the distance between the shield means and the wedge is such that the device may be attached to the motor vehicle door by inserting the distal end of the elongated rod within the gap between the window glass pane and the window sill of the vehicle to the extent of the wedge frictionally locking itself between the inside of the window glass pane and the window sill, with the shield means properly positioned adjacent to and overlying the actuating lever, thereby preventing a thin metal tool from engaging and manipulating the actuating lever upon insertion of the tool between the outer door panel and the window glass pane.

2. The motor vehicle, anti-theft device as claimed in claim 1, wherein the wedge is centered laterally on the rod.

3. The motor vehicle anti-theft device as claimed in claim 1, wherein the wedge projects to one side of the rod.

4. The motor vehicle anti-theft device as claimed in claim 1, wherein said device is of unitary form and of molded generally rigid plastic.

5. The motor vehicle anti-theft device as claimed in claim 1, wherein the leading edge of the wedge is angularly offset from the leading edge of the shield means along the longitudinal axis of the elongated rod.

6. The motor vehicle anti-theft device as claimed in claim 5, wherein said angular offset is approximately 90°.

7. The motor vehicle anti-theft device as claimed in claim 1, wherein the wedge is circumferentially offset along the longitudinal axis of the elongated rod from said shield means.

8. The motor vehicle anti-theft device as claimed in claim 1, wherein said wedge is tapered over its length parallel to the longitudinal axis of the rod, and the shield means whose thickness is adapted to be less than the gap between the window glass pane and the facing edge of the window sill has a tapered leading edge to facilitate insertion of the shield means between the window sill and the window glass pane.

9. The motor vehicle anti-theft device as claimed in claim 1, wherein the leading edge of the shield means is oblique to the rod axis at a predetermined angle from the distal end of the rod towards the proximate end of the rod to deter dislodgement of an anti-theft device after insertion of same into the door panel by the thin metal tool.

* * * * *